US007677193B2

(12) United States Patent
Roark et al.

(10) Patent No.: US 7,677,193 B2
(45) Date of Patent: Mar. 16, 2010

(54) CLOTH COVER FOR HATCH LID OF BOAT

(76) Inventors: Jeff Roark, 1275 Scotts Ferry Rd. East, Versailles, KY (US) 40383; Diana Roark, 1275 Scotts Ferry Rd. East, Versailles, KY (US) 40383

( * ) Notice: Subject to any disclaimer, the term of this patent is extended or adjusted under 35 U.S.C. 154(b) by 88 days.

(21) Appl. No.: 11/974,250

(22) Filed: Oct. 12, 2007

(65) Prior Publication Data

US 2008/0127879 A1 Jun. 5, 2008

Related U.S. Application Data

(60) Provisional application No. 60/851,405, filed on Oct. 13, 2006.

(51) Int. Cl.
*B63B 17/00* (2006.01)

(52) U.S. Cl. ..... 114/361; 114/201 R; 150/166

(58) Field of Classification Search ..... 114/361, 114/363, 201 R, 347, 364; 150/154, 158, 150/165, 166

See application file for complete search history.

(56) References Cited

U.S. PATENT DOCUMENTS

| | | | | | |
|---|---|---|---|---|---|
| 4,583,480 | A * | 4/1986 | Hamilton et al. | ..... | 114/347 |
| 5,161,478 | A * | 11/1992 | Strieb | ..... | 114/361 |
| 5,540,176 | A * | 7/1996 | Galea | ..... | 114/361 |
| 6,254,170 | B1 * | 7/2001 | Farmer et al. | ..... | 296/136.07 |
| 6,810,829 | B1 * | 11/2004 | McDaniel | ..... | 114/361 |
| 2003/0127038 | A1 * | 7/2003 | Moore | ..... | 114/361 |
| 2006/0226040 | A1 * | 10/2006 | Medina | ..... | 206/320 |
| 2007/0095271 | A1 * | 5/2007 | Yang | ..... | 114/361 |

* cited by examiner

*Primary Examiner*—Lars A Olson
(74) *Attorney, Agent, or Firm*—Stockwell & Smedley, PSC

(57) ABSTRACT

A cover for a hatch lid or similar structure of a boat provides a secure, custom fit but is easily replaceable and maintainable. The cover includes a sheet of material having a periphery sized approximately to fit over a hatch lid of a boat and a securing feature including an elastic band extending along a portion of the periphery of the sheet, configured to securely couple the sheet of material to the hatch lid. The cover also includes a first corner strap and a second corner strap located on an underside of the sheet of material configured to fit over respective corners of the hatch lid.

18 Claims, 12 Drawing Sheets

CLOTH COVER FOR HATCH LID OF BOAT

RELATED APPLICATIONS

This application claims priority to U.S. Application Ser. No. 60/851,405 filed Oct. 13, 2006 the disclosure of which is incorporated herein by reference in its entirety.

FIELD OF THE INVENTION

This invention relates generally to boating accessories and, more particularly, to a cover for the lid of a boat compartment.

BACKGROUND

Most recreational boats have some type of hatch lid or sundeck that is useful for seating or reclining by a user. Because these lids can be uncomfortable or made of material that can be slippery or uncomfortable when wet, boaters sometimes place towels on the hatch-lid panels of their boats, for recreational use when those boats are parked in groups, as well as when parked alone. However, towels can often come loose, often don't match the surface of the boat, and often get lost. Therefore, such a solution is inadequate for providing the comfort and safety that boaters would prefer. Consequently there remains a need for a secure cloth cover to a hatch-lid within a boat.

SUMMARY OF THE INVENTION

Embodiments of the present invention relate to cover for a hatch lid or similar structure of a boat that provides a secure, custom fit but is easily replaceable and maintainable. The cover includes a sheet of material having a periphery sized approximately to fit over a hatch lid of a boat and a securing feature including an elastic band extending along a portion of the periphery of the sheet, configured to securely couple the sheet of material to the hatch lid. The cover also includes a first corner strap and a second corner strap located on an underside of the sheet of material configured to fit over respective corners of the hatch lid.

It is understood that other embodiments of the present invention will become readily apparent to those skilled in the art from the following detailed description, wherein it is shown and described only various embodiments of the invention by way of illustration. As will be realized, the invention is capable of other and different embodiments and its several details are capable of modification in various other respects, all without departing from the spirit and scope of the present invention. Accordingly, the drawings and detailed description are to be regarded as illustrative in nature and not as restrictive.

BRIEF DESCRIPTION OF THE DRAWINGS

FIG. 1A shows a recreational boat, while

FIG. 2A shows an array of recreational boats, while

FIG. 3A shows an array of recreational boats, while FIG. 4A shows a hatch-lid for use with the present invention; while

DETAILED DESCRIPTION OF THE PREFERRED EMBODIMENTS

The detailed description set forth below in connection with the appended drawings is intended as a description of various embodiments of the invention and is not intended to represent the only embodiments in which the invention may be practiced. The detailed description includes specific details for the purpose of providing a thorough understanding of the invention. However, it will be apparent to those skilled in the art that the invention may be practiced without these specific details. In some instances, well known structures and components are shown in block diagram form in order to avoid obscuring the concepts of the invention.

Figure 1A:
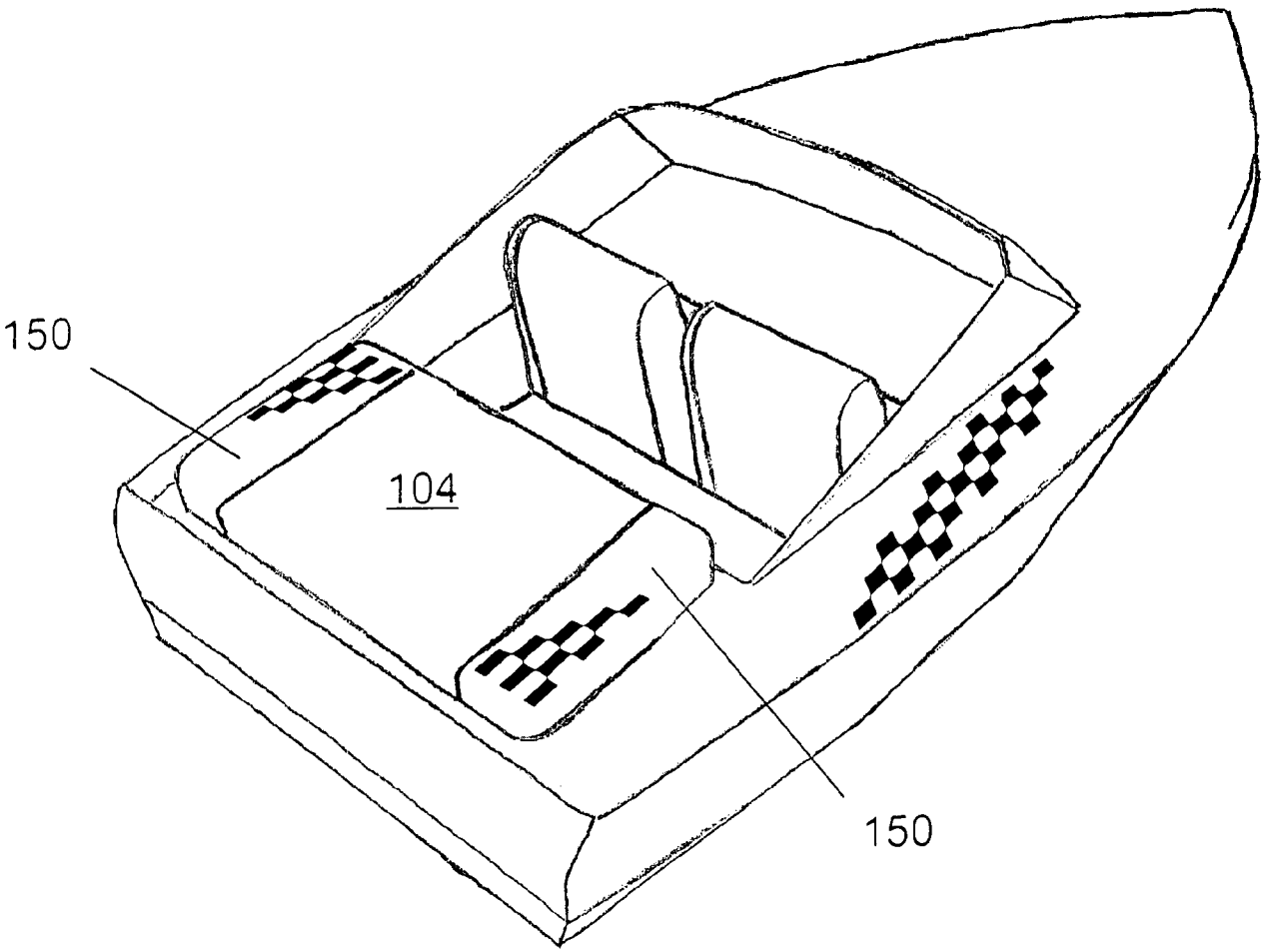

FIG. 1A shows a recreational boat having a hatch-lid panel 104, most often used for concealing but allowing access to an engine compartment. Although the terms "hatch" and "hatch lid" are used through this specification, the term is intended to encompass what boaters generally refer to a sundeck, sunpad, engine hatch, engine lid, hatch, engine compartment cover, layout pad, and transom.

The hatch-lid 104 may sometimes be adjoined by decorative cushions 150. From FIG. 1A it is apparent that the boat has various decorative markings thereupon, yet in many instances the hatch-lid cover 104 may not have any of these same markings.

During recreational use of a boat, particularly when the boat is not in motion and several boats are parked together, it is enticing to sit and relax on the hatch-lid 104 of a boat. However, certain disadvantages can occur during such a sitting. First, the plastic or vinyl surface of the hatch-lid 104 may absorb sunlight and thus be very hot and uncomfortable in contact with human flesh. Additionally, the hardness of the hatch-lid 104 may be uncomfortable after long periods of contact and it may even be slippery when wet if it does not have some type of anti-skid material. Some boat users address this by simply placing a towel on the hatch-lid 104 and then sitting on the towel. For many reasons, however, this solution is inadequate because the towel can become dislodged, it cannot easily be used for other purposes while being sat on, and can be lost while a boater is getting in or out of the water.

Figure 1B:
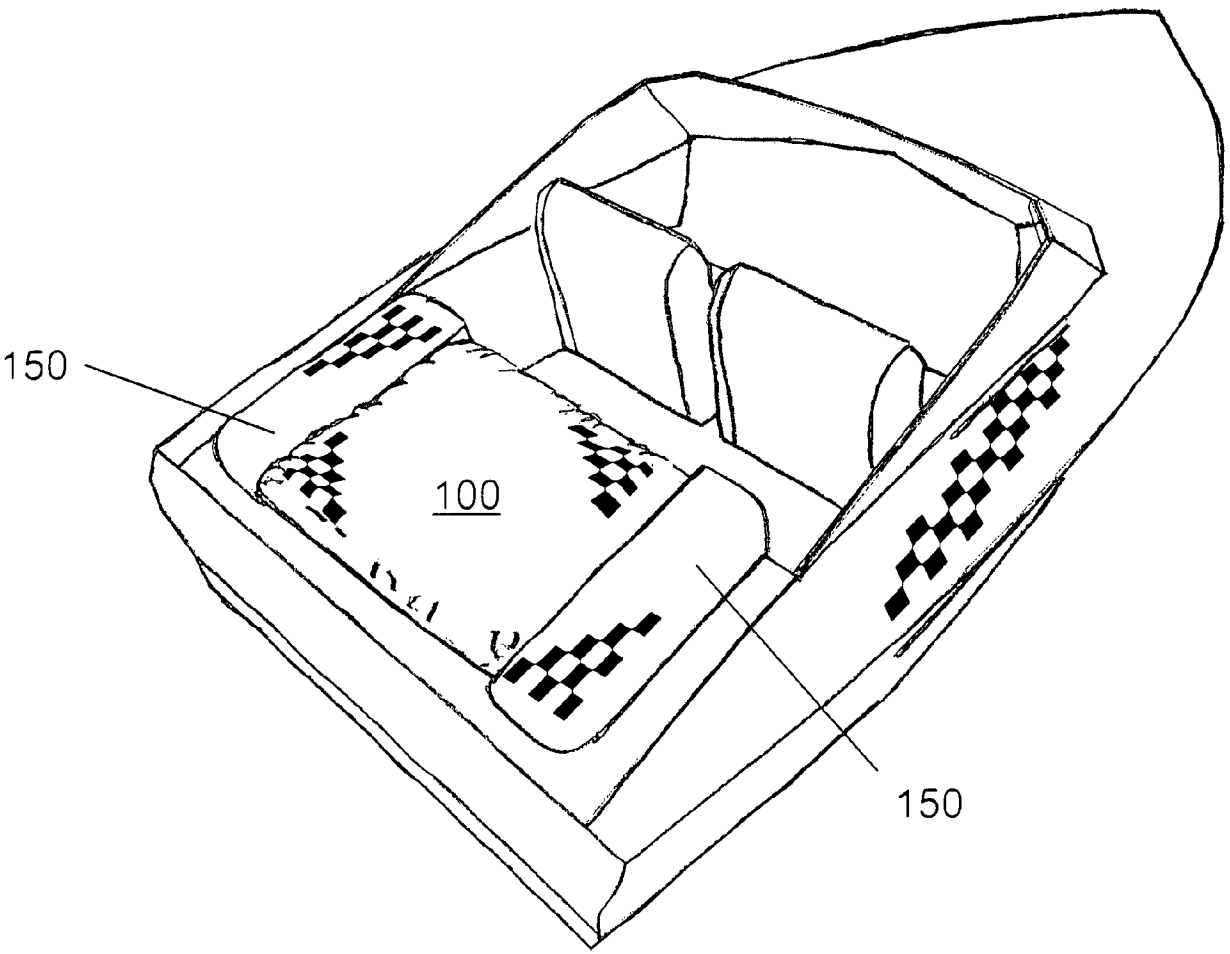
FIG. 1B shows an exemplary embodiment of the present invention installed within the boat of FIG. 1A.

To address this, FIG. 1B shows the same boat having that hatch-lid 104 with a cover 100 in accordance with the principles of the present invention. As shown, the cover 100 can include matching markings, if desired, that coordinate with the designs of the boat.

Figure 2A:
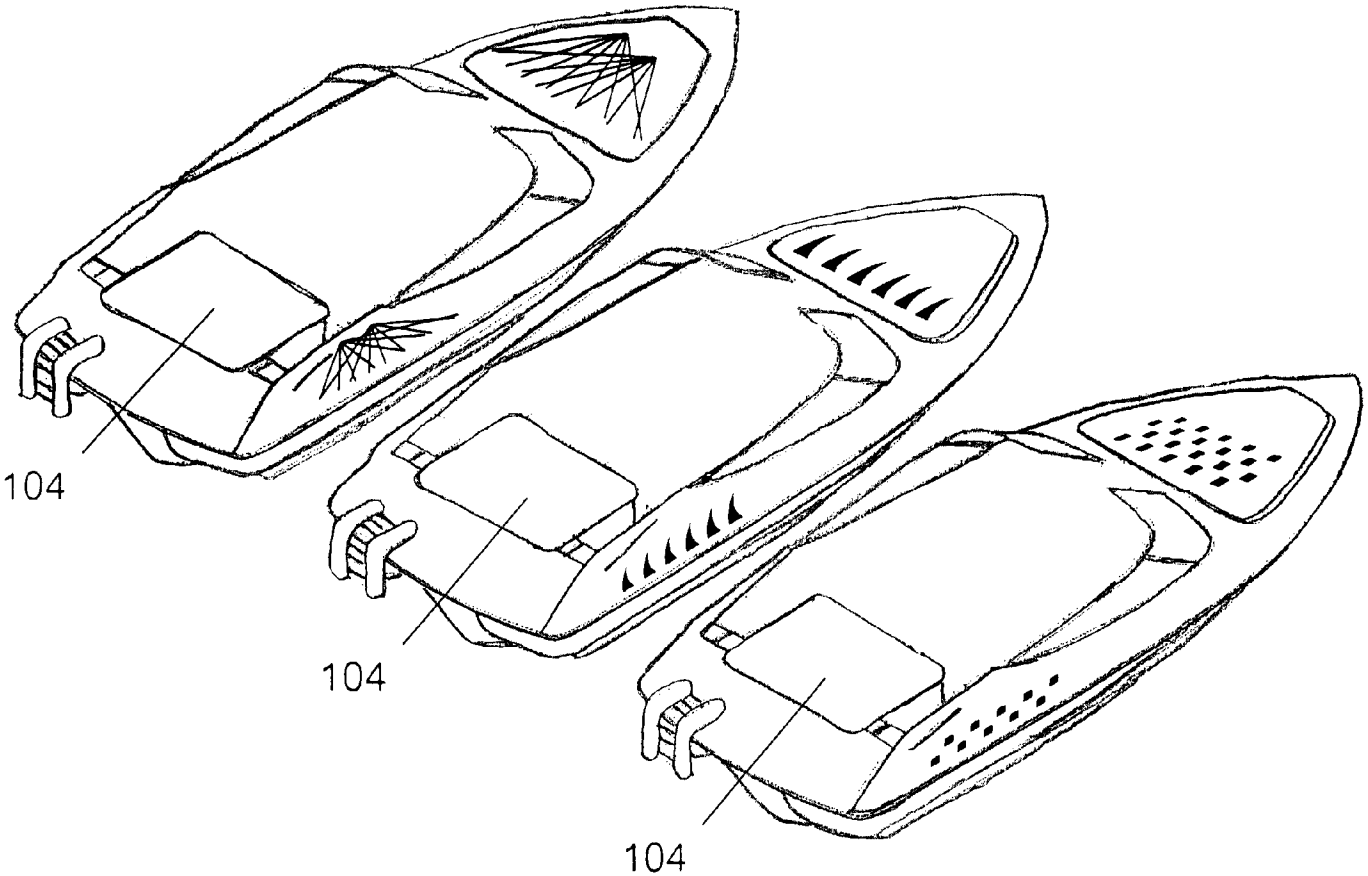
Figure 2B:
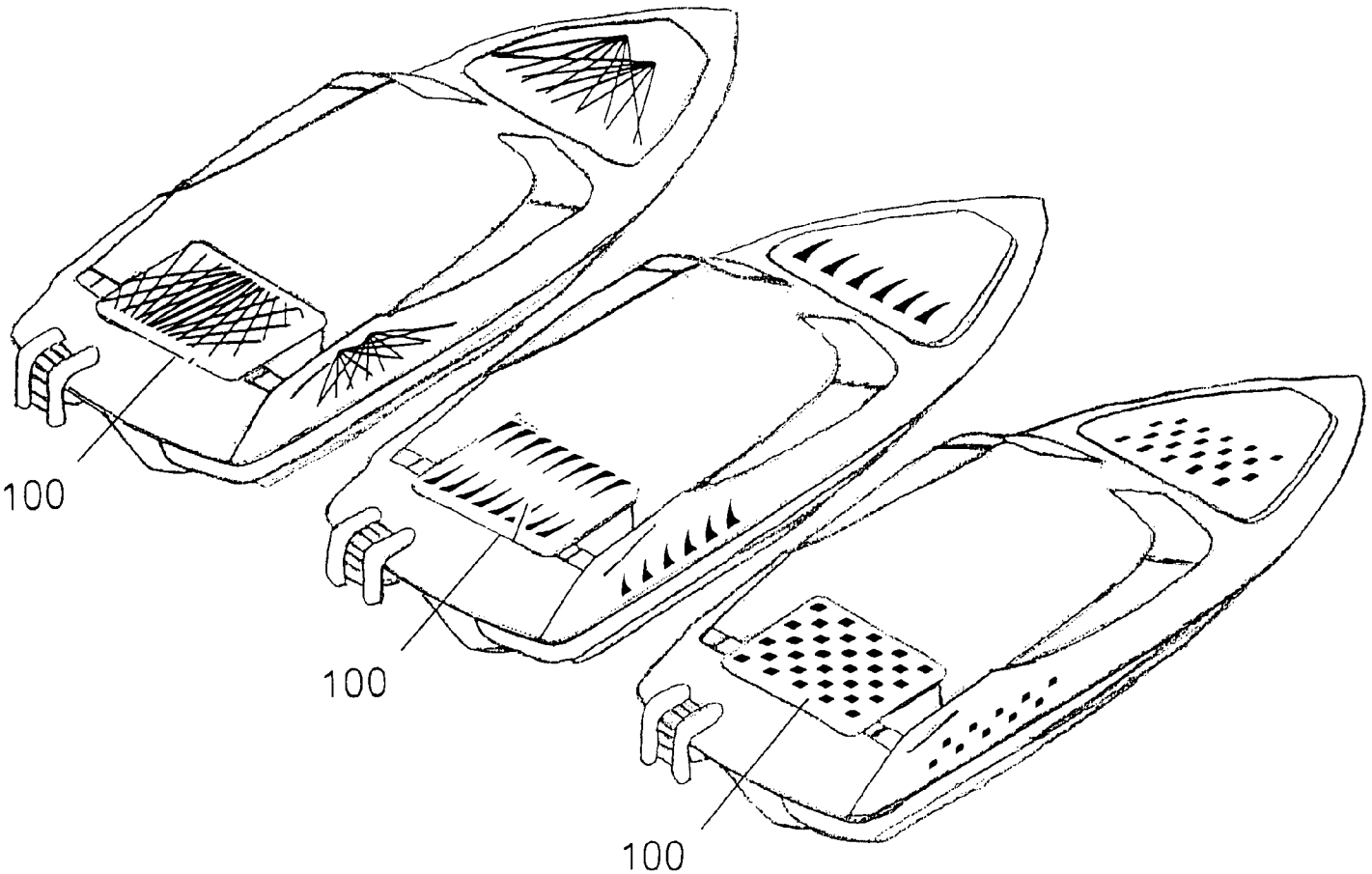
FIG. 2B shows various embodiments of the present invention installed within the boats of FIG. 2A.

FIG. 2A shows an array of recreational boats, while FIG. 2B shows various embodiments of the present invention installed within the boats of FIG. 2A. From FIG. 2A it is apparent that different styles of boats can have different decorative markings and detailing. From FIG. 2B it is apparent that the cover 100 of the present invention can accommodate and in fact enhance and accentuate these markings and detailing.

Figure 3A:
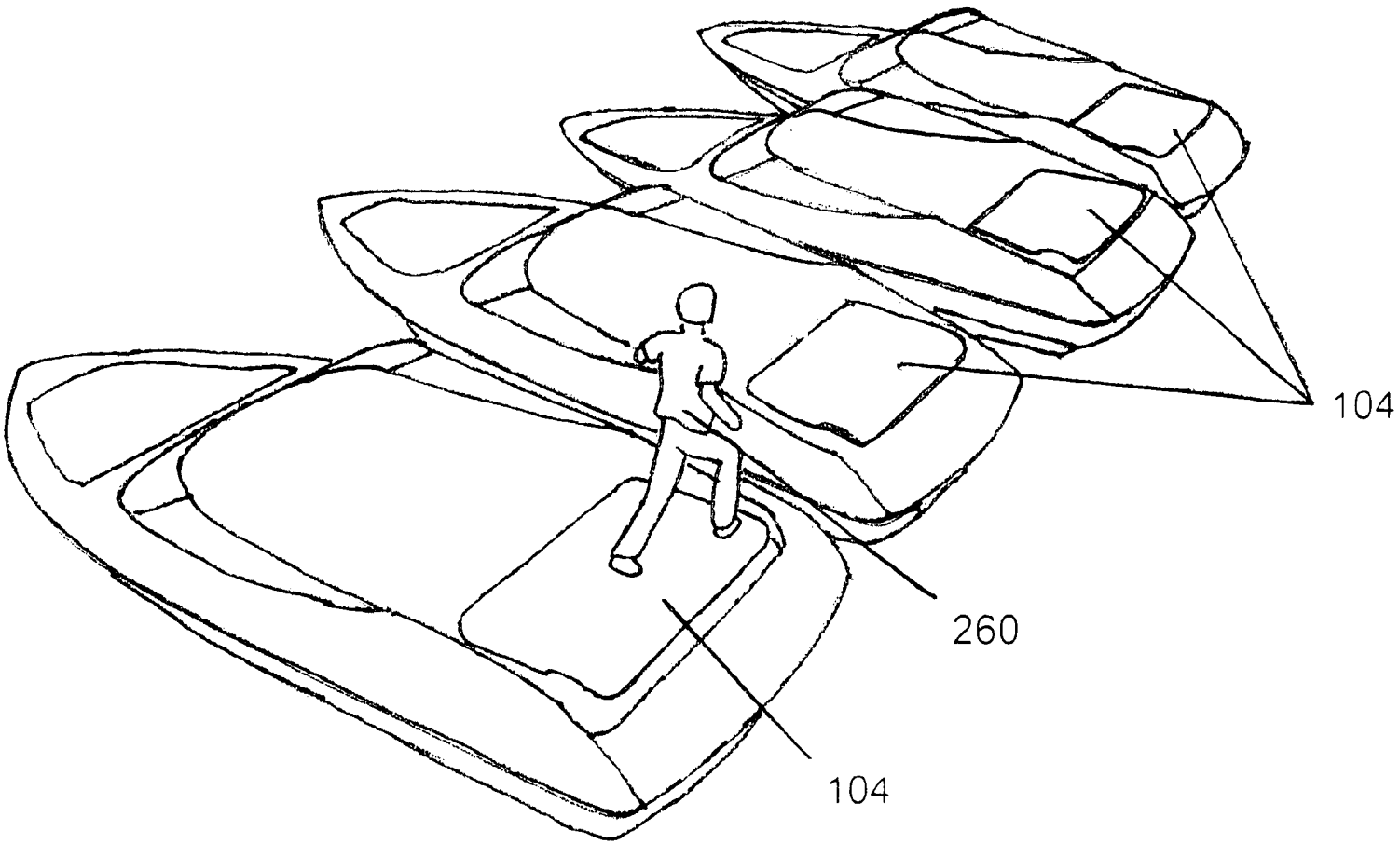

FIG. 3A shows an individual 260 moving from one boat to another. The possibility of the individual slipping on a hatch-lid 104, or at least not having a good surface to walk on, is high. Second, even if the hatch-lid 104 is covered with a towel, the possibility of the towel moving or getting lost could occur, possibly to the detriment of the individual. The individual would not be able to walk from one boat to another without risk of injury.

Figure 3B:
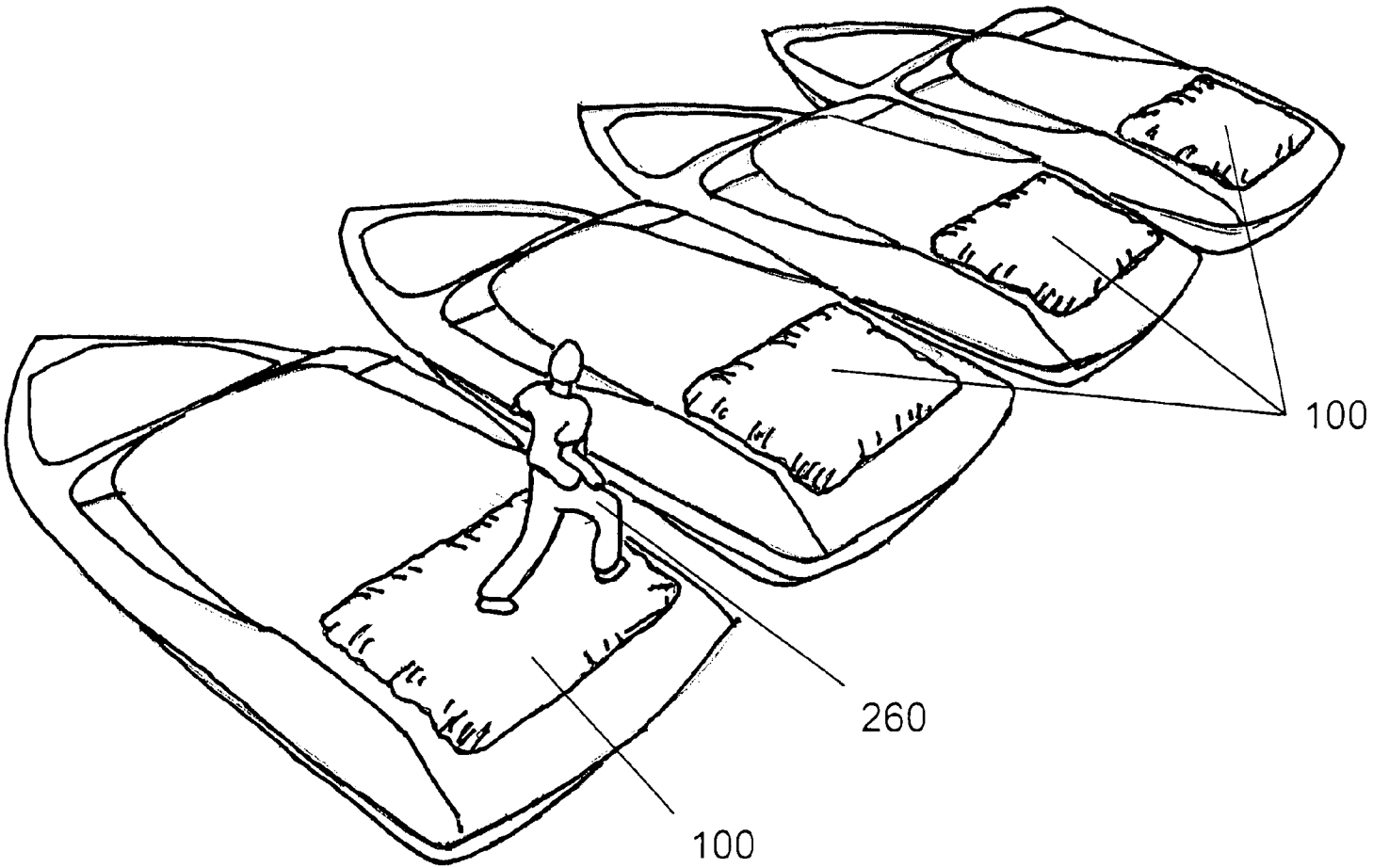
FIG. 3B shows various embodiments of the present invention installed within the boats of FIG. 3A.

To address this, FIG. 3B shows various embodiments of the cover 100 of the present invention installed within the boats of FIG. 3A.

Figure 4A:
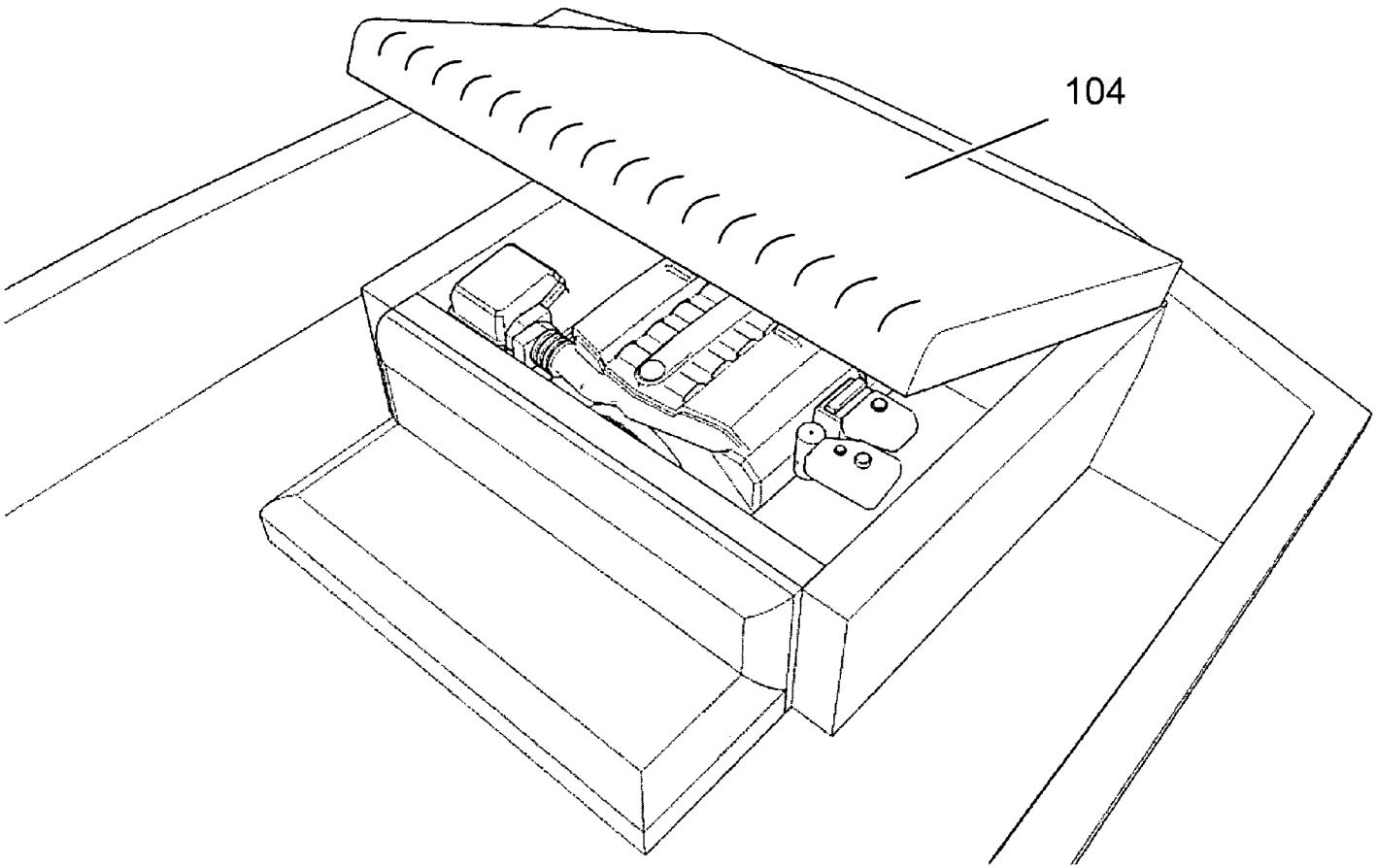
Figure 4B:
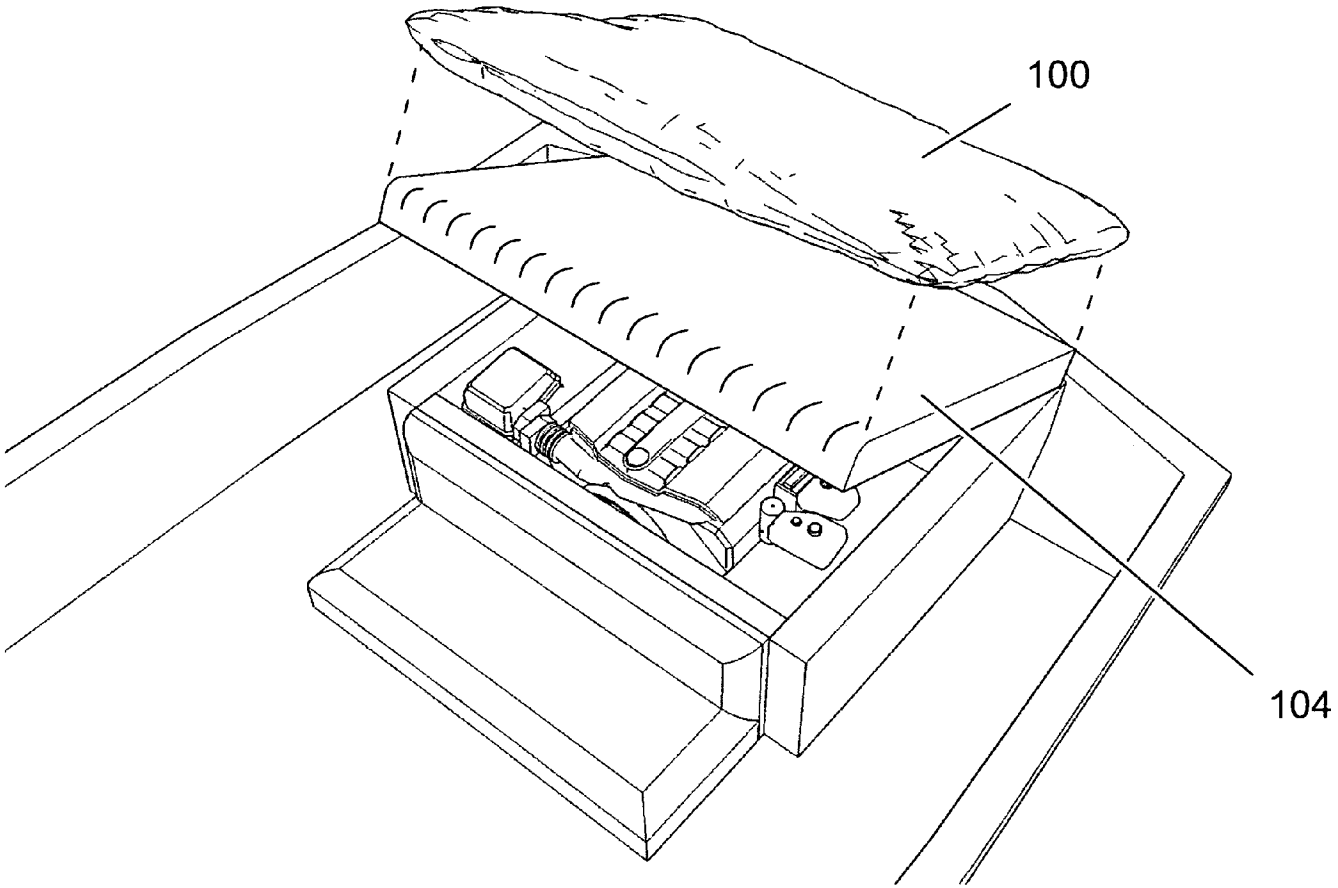
FIG. 4B shows the present invention positioned nearby the hatch-lid of FIG. 4A.

FIG. 4A shows a hatch-lid 104 for use with the present invention. From FIG. 4A it is apparent how the hatch-lid 104 movably covers an engine compartment. FIG. 4B shows a cover 100 positioned just above the hatch-lid 104 of FIG. 4A. It is to be noted that the hatch-lid 104 need not necessarily be open in order to install the cover 100, depending on how tightly the hatch-lid 104 is concealed within the structure of the boat, the width of the gaps therebetween, dimensional shape of the hatch-lid 104, and other factors. It is to be noted that many different styles and shapes of hatch-lids exist, so that the present invention should not be considered as limited only to the embodiment shown in FIGS. 4A and 4B.

For example, the figures all show a hatch-lid of basically rectangular shape, and that the covers 100 conform thereto. However, the cover 100 can be customized to a variety of shapes and dimensions, and can have a variety of patterns incorporated therein. Accordingly, the embodiments shown in the figures and described herein should not be considered as limiting the invention exclusively thereto.

The cover 100 can be made of a high-grade high-durability terrycloth, although the present invention should not be considered as limited exclusively thereto. As described later, the cover 100 can be equipped with an elastic band (not shown) around its periphery for effectively gripping the surface of the hatch-lid 104 and staying in place and not slipping. A drawstring embodiment is also contemplated within the spirit and scope of the present invention, possibly in substitute for but also in combination with the elastic band embodiment. In either case, the aperture for accommodating either the elastic band or the drawstring can be sewn into the cover 100 and encompass its entire border, but also a series of holes and eyelets can be used.

The sewing of the specific patterns and identifiable logos into the cover 100 can be achieved through a hand-sewing process, embroidering, an appliqué process, or through use of pre-programmed computerized patterns.

Figure 5:
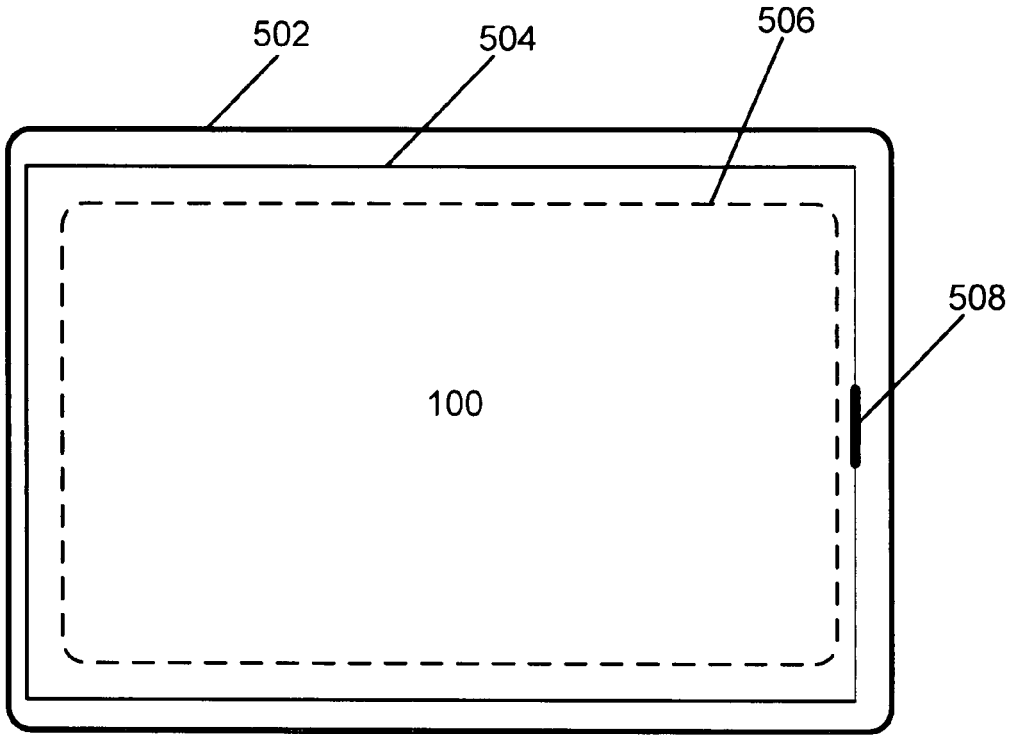
FIGS. 5-9 illustrate particular details about embodiments of the present invention.

FIG. 5 illustrates particular details about an embodiment of the present invention. According to this embodiment, a channel exists between an outer periphery 502 of the cover 100 and an inner stitching 506. Such an arrangement can be accomplished, for example, by folding over the edges around the periphery to create the channel. The stitching 506 can be double stitched to provide strength. Within the channel resides elastic strap 504 that has an adjustment mechanism 508. For example, the adjustment mechanism 508 can be a clip or other connection means that allows the two ends of the strap 504 to adjustably slide into an appropriate position. Accordingly, the cover 100 can beneficially be adjusted once for a very close fit and not need further adjustment. The elastic strap 504 preferably extends the entire periphery of the cover 100. However, in alternative embodiments, the elastic strap may only extend along a portion of the cover's periphery. An exemplary strap adjustment mechanism is depicted in U.S. Pat. No. 5,769,295 (herein incorporated by reference in its entirety); but one of ordinary skill will recognize that a variety of functionally equivalent mechanisms can be used without departing from the scope of the present invention.

As for material, the cover 100 may be constructed of a synthetic or natural material having properties similar to CoralFleece™. This material is soft and absorbent while being resistant to salt water, sunshine and wear. It is machine washable and dryable and is durable so that it does not fade or shrink.

Figure 6:
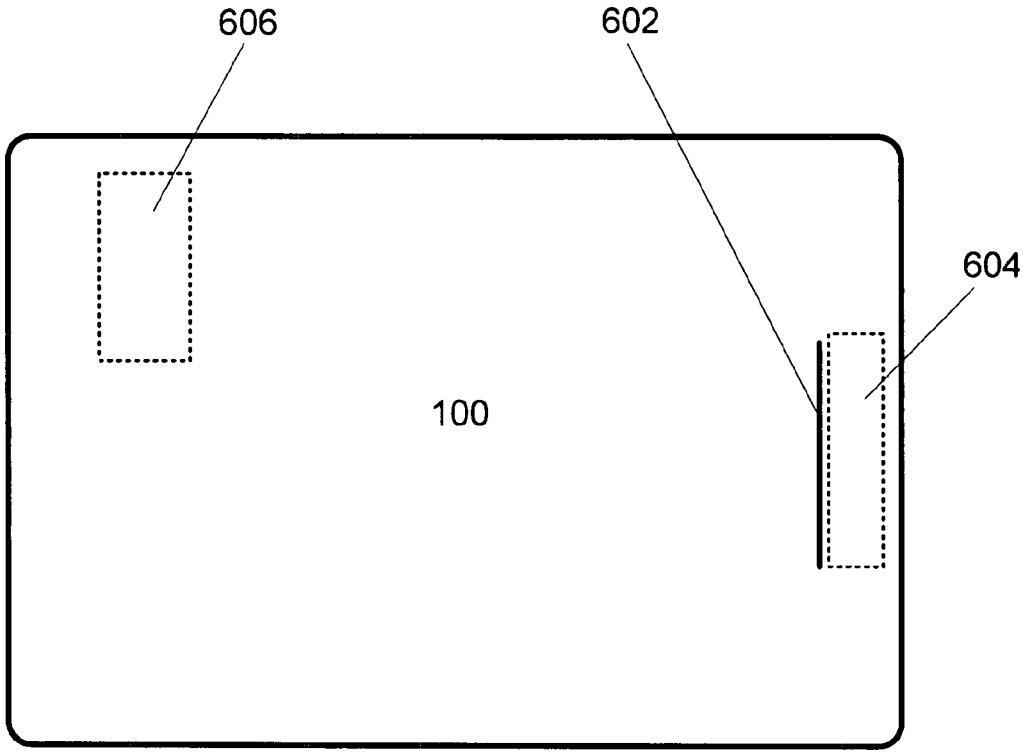

FIG. 6 illustrates the cover 100 and some additional features. A flap 604 is included that has a releasable fastener (e.g., hook and loop) 602. This flap 604 allows access to the adjustment mechanism 508 that is shown in FIG. 5. Also shown in FIG. 6 is a pocket 606. This pocket 606 may be sewn into the cover 100 or be detachable. The pocket 606 may be connected to the cover 100 with a releasable fastener such as a hook and loop fastener. While only one pocket is shown, embodiments of the present invention contemplate a plurality of pockets as well positioned in a variety of positions without interfering with the operation of the cover 100.

Figure 7:
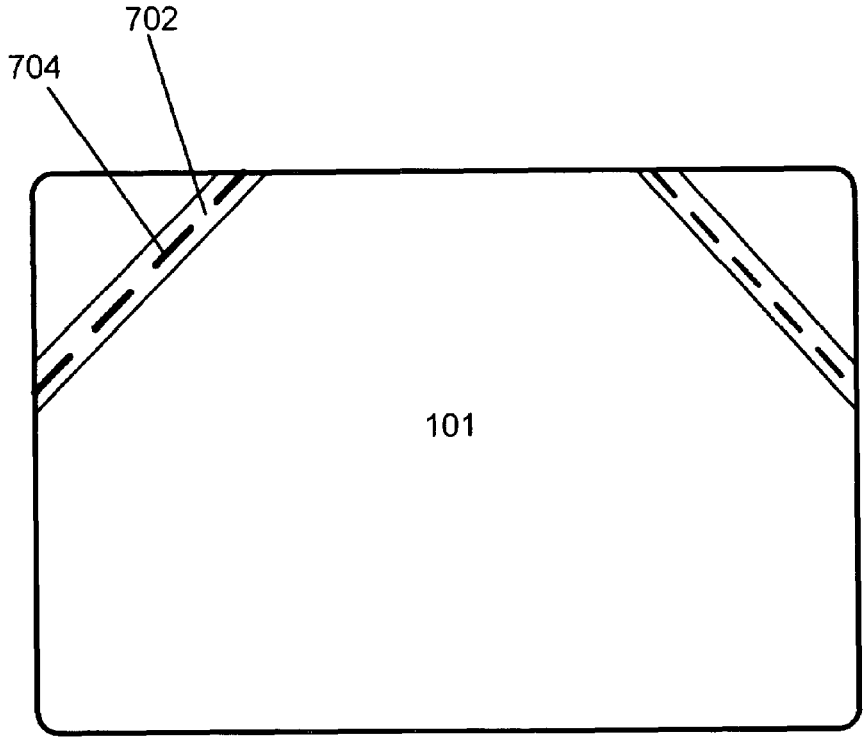
Figure 8:
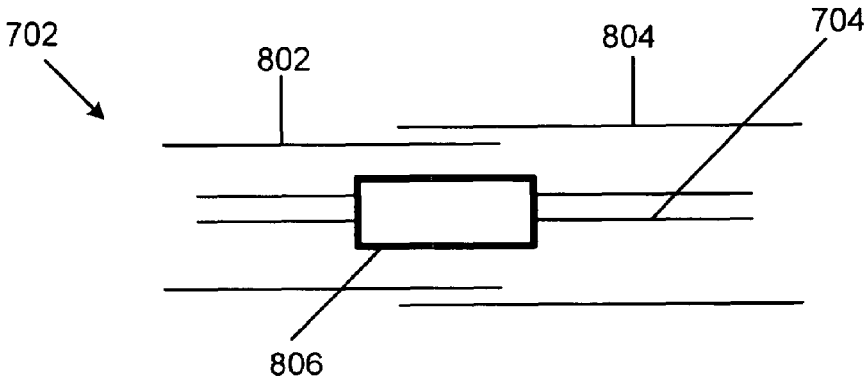
Figure 9:
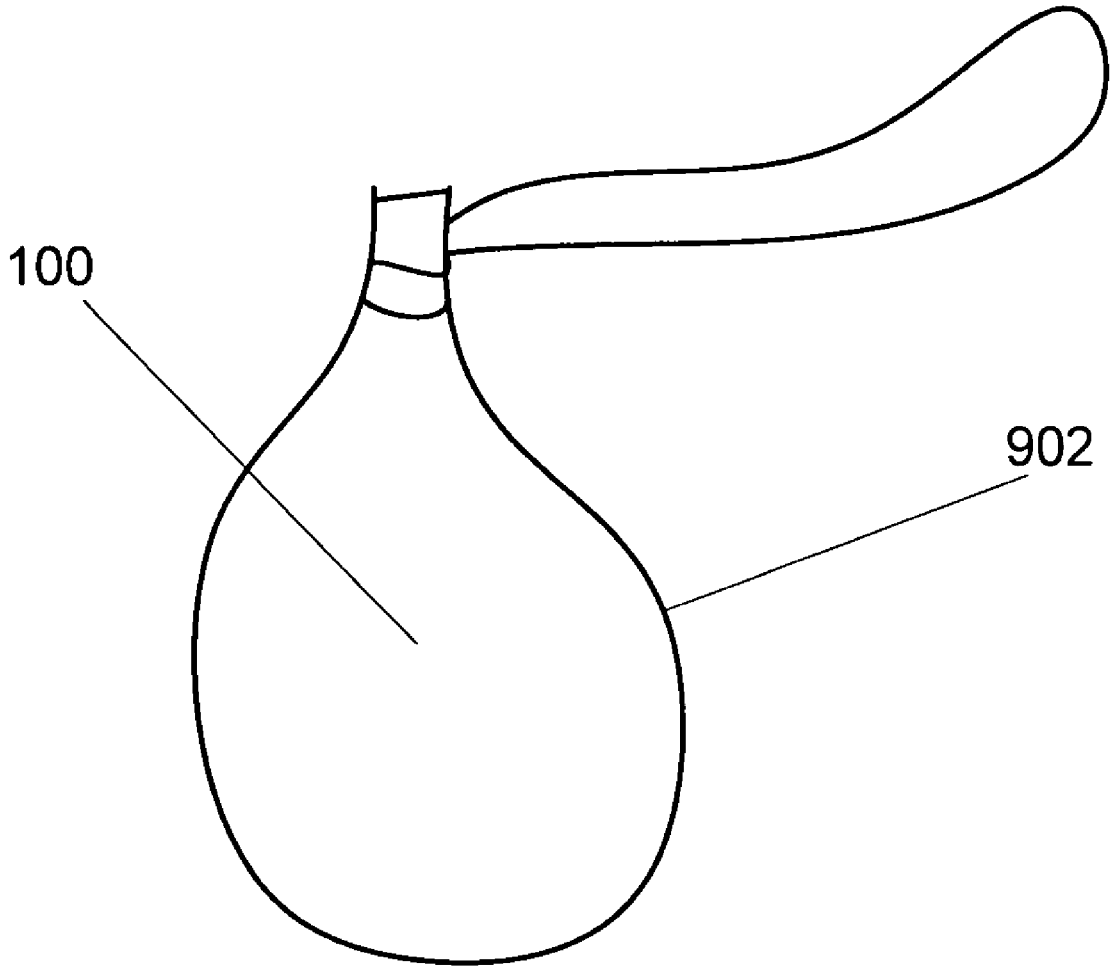

FIGS. 7 and 8 show the underside 101 of the cover. This underside 101 may be constructed of a non-slip material that is bonded with the soft material of the cover 100. There are two corner straps shown in FIG. 7 that help hold the cover 100 in place while it is on a hatch lid. The strap 702 is preferably of the same material as the cover 100 and provides a channel in which an elastic strap 704 is located. The other strap (not numbered) is preferably of similar construction.

FIG. 8 provides details of one embodiment of such an adjustment strap 702. Two ends of the strap 704 are connected to an adjustment mechanism 806 that allows the strap 702 to be tightened or loosened. The elastic strap 704 and mechanism 806 are located within two overlapping sleeves 802 and 804. These sleeves are long enough to completely cover the mechanism 806 to provide protection of it and the boats surface. The sleeves 802, 804 are simply moved away by hand to provide access to the mechanism 806.

The cover 100 can be accompanied by a mesh or nylon bag 902 for storage. The bag 902 preferably allows the cover to breath during storage so that mold and mildew are avoided.

The previous description is provided to enable any person skilled in the art to practice the various embodiments described herein. Various modifications to these embodiments will be readily apparent to those skilled in the art, and the generic principles defined herein may be applied to other embodiments. Thus, the claims are not intended to be limited to the embodiments shown herein, but are to be accorded the full scope consistent with each claim's language, wherein reference to an element in the singular is not intended to mean "one and only one" unless specifically so stated, but rather "one or more." All structural and functional equivalents to the elements of the various embodiments described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. §112, sixth paragraph, unless the element is expressly recited using the phrase "means for" or, in the case of a method claim, the element is recited using the phrase "step for."

The invention claimed is:

1. A hatch lid cover comprising:

a sheet of material having a periphery sized approximately to fit over a hatch lid of a boat;

a securing feature including an elastic band extending along a portion of the periphery of the sheet, configured to securely couple the sheet of material to the hatch lid;

a first corner strap and a second corner strap located on an underside of the sheet of material configured to fit over respective corners of the hatch lid; and a channel extending along the periphery of the sheet, wherein the elastic band is located within the channel.

2. The hatch lid cover of claim 1, wherein the elastic band extends along the entire periphery of the sheet.

3. The hatch lid cover of claim 1, wherein the securing feature further comprises:

an adjustment mechanism configured to adjust an operating length of the elastic band.

4. The hatch lid cover of claim 3, wherein the sheet further comprises a flap located adjacent the adjustment mechanism configured to provide access to adjust the adjustment mechanism.

5. The hatch lid cover of claim 1, wherein each of the first and second corner straps include a respective elastic strap.

6. The hatch lid cover of claim 5, wherein each of the respective elastic straps includes a respective adjustment mechanism configured to adjust an operating length of each of the respective elastic straps.

7. The hatch lid cover of claim 1, wherein each of the first and second corner straps includes a respective outer sleeve constructed from the same material as the sheet of material.

8. The hatch lid cover of claim 1, further comprising a pocket located on an upper side of the sheet.

9. The hatch lid cover of claim 8, wherein the pocket is detachable from the sheet of material.

10. The hatch lid cover of claim 1, wherein a graphic design on the sheet of material is configurable.

11. The hatch lid cover of claim 10, wherein the graphic design is embroidered onto the sheet of material.

12. The hatch lid cover of claim 1 further comprising a storage bag configured to reduce moisture retained by the cover during storage.

13. The hatch lid of claim 1, wherein at least a portion of the underside of the sheet of material includes an anti slip material.

14. A boat comprising:

a hatch lid including a removable cover;

the removable cover comprising:

a sheet of material having a periphery sized approximately to fit over the hatch lid;

a securing feature including an elastic band extending along a portion of the periphery of the sheet, configured to securely couple the sheet of material to the hatch lid;

a channel extending along the periphery of the sheet, wherein the elastic band is located within the channel; and a first corner strap and a second corner strap located on an underside of the sheet of material configured to fit over respective corners of the hatch lid.

15. The boat of claim 14, wherein the securing feature further comprises:

an adjustment mechanism configured to adjust an operating length of the elastic band.

16. The boat of claim 14, wherein each of the first and second corner straps includes a respective elastic strap.

17. The boat of claim 16, wherein each of the respective elastic straps includes a respective adjustment mechanism configured to adjust an operating length of each of the respective elastic swaps.

18. A method for covering a hatch lid of a boat, comprising:

placing over the hatch lid a sheet of material having a periphery sized approximately to fit over the hatch lid;

securing the sheet of material to the hatch lid using a securing feature, that includes an elastic band located within a channel extending around the periphery of the sheet, that is configured to securely couple the sheer of material to the hatch lid;

positioning over respective corners of the hatch lid a first corner swap and a second corner strap located on an underside of the sheet of material;

adjusting an operating length of the elastic band to conform the sheet of material to the hatch lid; and adjusting a respective operating length of the first and second corner straps to assist with securely coupling the sheet of material to the hatch lid.

* * * * *